US007258334B2

(12) United States Patent
Cheng

(10) Patent No.: US 7,258,334 B2
(45) Date of Patent: Aug. 21, 2007

(54) PAPER TRAY MECHANISM

(75) Inventor: Chung-Yi Cheng, Taichung (TW)

(73) Assignee: Lite-On Technology Corporation, Taipei (TW)

( * ) Notice: Subject to any disclaimer, the term of this patent is extended or adjusted under 35 U.S.C. 154(b) by 450 days.

(21) Appl. No.: 10/844,453

(22) Filed: May 13, 2004

(65) Prior Publication Data

US 2005/0116406 A1 Jun. 2, 2005

(30) Foreign Application Priority Data

Nov. 28, 2003 (TW) ..... 92221051 U

(51) Int. Cl.
*B65H 5/22* (2006.01)

(52) U.S. Cl. ..... 271/3.14; 271/162; 271/213

(58) Field of Classification Search ..... 271/3.14, 271/162, 163, 213; 347/104
See application file for complete search history.

(56) References Cited

U.S. PATENT DOCUMENTS 6,830,401 B1 * 12/2004 Hwang et al. ..... 400/693
6,848,685 B2 * 2/2005 Katsuyama ..... 271/162
2005/0104280 A1 * 5/2005 Wong et al. ..... 271/162

FOREIGN PATENT DOCUMENTS

JP 5-77507 A * 3/1993

* cited by examiner

*Primary Examiner*—David H. Bollinger
(74) *Attorney, Agent, or Firm*—Birch, Stewart, Kolasch & Birch, LLP

(57) ABSTRACT

A paper tray mechanism that is applicable to machines with paper trays, such as printers, scanners, copiers, fax machines, all-in-one multifunction center and the like, comprises an input paper tray, an output paper tray, where both trays are movable and attached to the machine at sides, and an interconnecting mechanism therein between the two trays. When one paper tray is moved by the user, due to the interconnecting mechanism therein between, another paper tray will automatically move simultaneously. Therefore, this invention provides a paper mechanism that only needs one simple and easy step to have both paper trays unfolded/folded and unstashed/stashed so that some spaces are saved for other usage and machine is compact enough to be repacked into the original box.

11 Claims, 3 Drawing Sheets

PAPER TRAY MECHANISM

This Non-provisional application claims priority under 35 U.S.C. § 119(a) on Patent Application No(s). 092221051 filed in Taiwan on Nov. 28, 2003, the entire contents of which are hereby incorporated by reference.

FIELD OF THE INVENTION

This invention relates to a paper tray mechanism which can be used in machines consisting both input and output paper trays, such as printer, scanner, fax machine, copier, and all-in-1 multifunction center.

BACKGROUND OF THE INVENTION

Even though many uses of papers have been replaced by electronic documentations due to concerns of environmental issues, documents still have to be printed on papers under certain circumstances. With the help of machines such as printer, copier, fax machine, scanner, and all-in-one multifunction center, graphics, symbols, texts, and pictures can be printed onto papers for a better visualization and comprehension of the enclosure. A printer, as an instance, usually contains at least one set of the printing mechanism and one set of the paper transporting mechanism. After a paper enters the printer, the paper transporting mechanism passes the paper to the printing mechanism inside the printer to have graphics, symbols, texts, and pictures printed onto the paper; then the paper transporting mechanism outputs the paper from the printer. In order to ensure the paper which enters and exits the printer is flat, paper trays, either fix or movable, are usually included and attached at the paper entrance and exit ends of the printer. If the movable paper trays are used for both input and output paper trays, paper trays can be either folded along the side of the printer or slid into the printer body to allow more spaces for other usage or to have the printer ready to repack into the original box. Nevertheless, using printers with movable paper trays require more setting up/unset up steps. In order to have the printer ready, the user has to either unfold or pull out the paper trays one by one before papers can be fed into it. On the other hand, after using the printer, the movable paper trays need to be either folded or slid in separately before the printer is compact enough to free up spaces for other usage or repack into the original box.

SUMMARY OF THE INVENTION

Prior movable paper trays are independently attached or pivoted to the body of machines consisting paper trays. Both trays have to be either unfolded/folded or pulled out/slid in one by one separately. Although not many steps are required to follow before the machine is ready to either be used, be repacked into the original box, or provide spaces for other usage, some user still find it troublesome. Since machines with paper trays, such as printers, scanners, copiers, fax machines and the like, are one of the essential apparatus in daily life, finding a way to have the input and output paper tray to move simultaneously is the objective this invention. Therefore, this invention discloses a paper tray mechanism that can be used in machines having movable input and output trays so that one paper tray will move according to the other paper tray simultaneously.

This invention discloses a paper tray mechanism that can be used in machines consisting movable input and output paper trays, comprising an input paper tray, an output paper tray, and an interconnecting mechanism therein between the paper trays. Both the input and output paper trays are pivoted or flexibly connected to the body of the machine. With the interconnecting mechanism inside the machine body, unfolding/fold or pull out/slide in one tray will automatically unfold/fold or pull out/slide in the other tray and vice versa. Therefore, this invention of a paper tray mechanism not only accomplished the essential purpose of having movable paper trays, which is to provide spaces for other usage and enable the machine to be compact enough to be packed, it also requires only one quick, easy, and simple step to set up/unset both paper trays.

Further scope of the applicability of the present invention will become apparent from the detailed description and specific examples given hereinafter. However, it should be understood that the detailed description and specific examples, while indicating preferred embodiments of the invention, are given by way of illustration only, since various changes and modifications within the spirit and scope of this invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The paper tray mechanism enclosed in this invention is applicable to machines with movable paper trays, such as printers, scanners, fax machines, all-in-one multifunction centers, and the like. The components contained in the machines mentioned above usually include at least one printing mechanism and at least one paper transporting mechanism. Once the paper is fed into the machine, the paper transporting mechanism will keep transporting it until the printing job is done by the printing mechanism. Since the structures and operation of the aforementioned machines are well known, no further explanation will be provided.

Figure 1A:
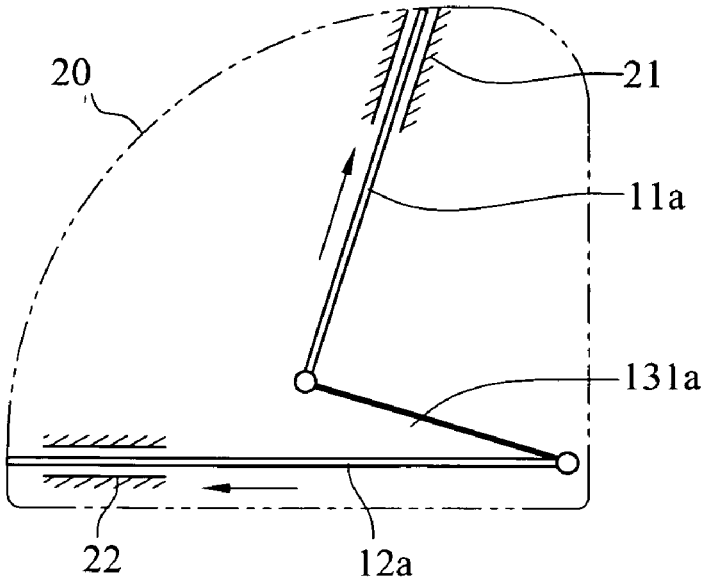
FIGS. 1A and 1B are the side views of the first embodiment of this invention.
Figure 1B:
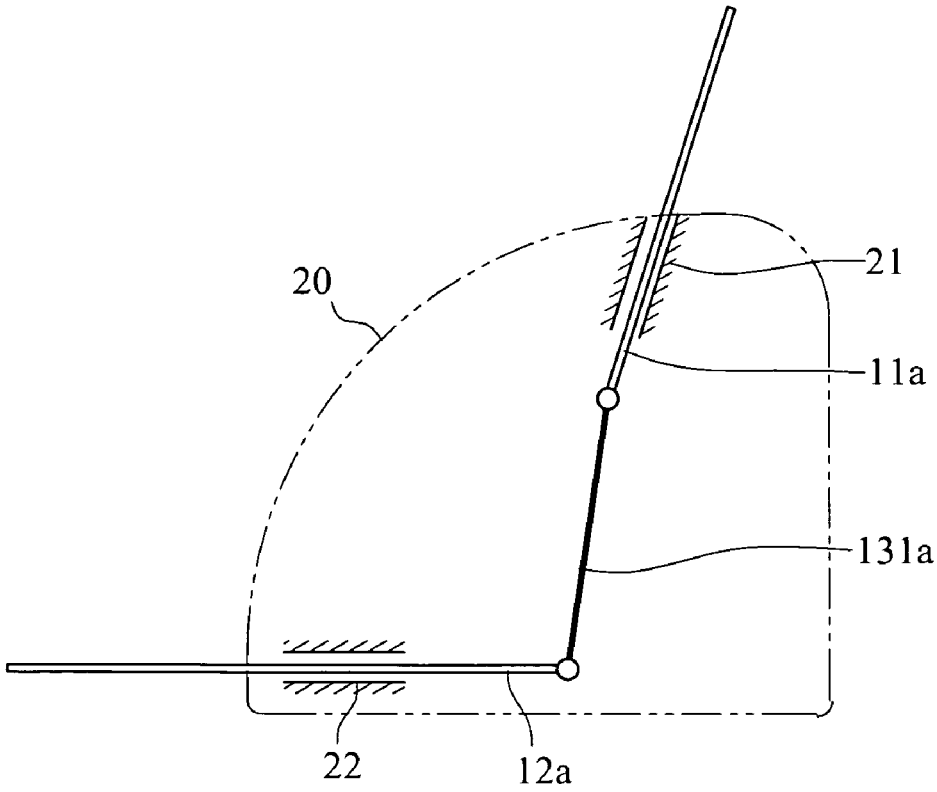

FIGS. 1A and 1B shows the first embodiment of this invention. According to the first embodiment of this invention, a paper tray mechanism mainly comprises an input paper tray 11*a*, an output paper tray 12*a*, and a linkage 131*a*. FIG. 1A shows the position of the paper trays when they are not in used while in FIG. 1B, both trays are in the ready-to-serve position. Input paper tray 11*a* is a tray that can hold up a plurality of papers (not shown in the figure) and slides along the sliding track 21 inside the machine 20 (the dotted line shown in the figure), a printer in this case. As shown in the figures, the input paper tray 11*a* is at the rear end of the machine 20 and tilted at an angle with the machine 20. Output paper tray 12*a* is also a tray that can hold up a plurality of papers and slides horizontally along the sliding track 22 inside the machine 20. Since linkage 131*a* connects the input and output paper trays and is pivotally pinned to the input paper tray 11*a* at one end and to the output paper tray 12*a* at the other end, linkage 131*a* is suspended inside machine 20.

Referring to FIGS. 1A and 1B, when both input and output paper trays are not in use, to set up the machine 20, the user has to pull the input paper tray 11*a* to slide it upright along the sliding track 21. Since the linkage 131*a* is pivotally pinned to the input paper tray 11*a* and output paper tray 12*a* respectively, pulling the input paper tray 11*a* will simultaneously pull the linkage 131*a* upright which, at the same time, will push the output paper tray 12*a* to slide leftward along the sliding track 22. To tidy up the machine 20 after used to generate some spaces for other usage, the user only has to push the input paper tray 11*a* to slide it back into the machine 20 while the linkage 131*a* is pushed downward by the input paper tray 11*a* and the output paper tray 12*a* is dragged rightward into the machine 20 by the linkage 131*a*. On the other hand, to have the machine ready to be used, instead of pulling the input paper tray 11*a*, the user can also pull out the output paper tray 12*a* to simultaneously push out the input paper tray 11*a* with the help of the linkage 131*a*. Thus, the user can pull/push either the input or output paper tray to automatically push/pull the other paper tray out/into the machine 20.

In the first embodiment of this invention, since both output paper tray 11*a* and input paper tray 12*a* are moved by sliding along the sliding tracks inside the machine 20, they can be kept inside the machine 20 to make more spaces available for other usage. However, this invention can also be applied to other embodiments. The motion and connection relation of the input paper tray 11*a* and output paper tray 12*a* in other embodiments will be further described in detail.

Figure 2A:
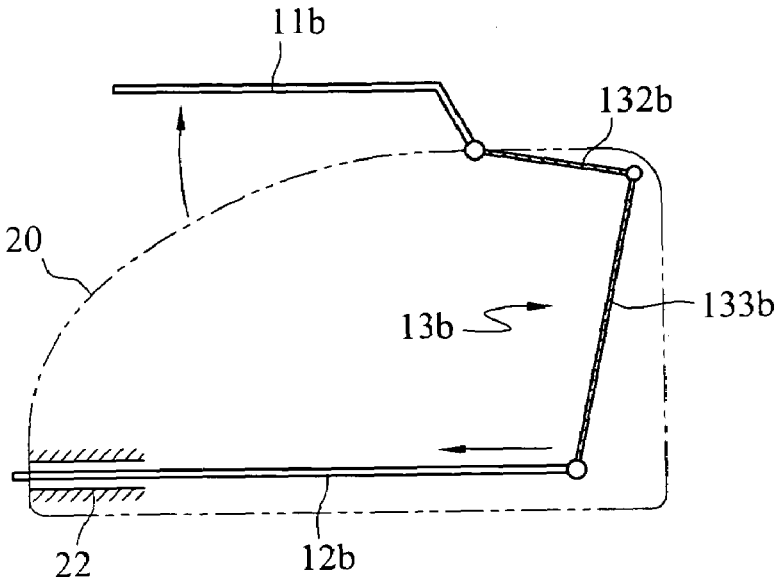
FIGS. 2A and 2B are the side views of the second embodiment of this invention.
Figure 2B:
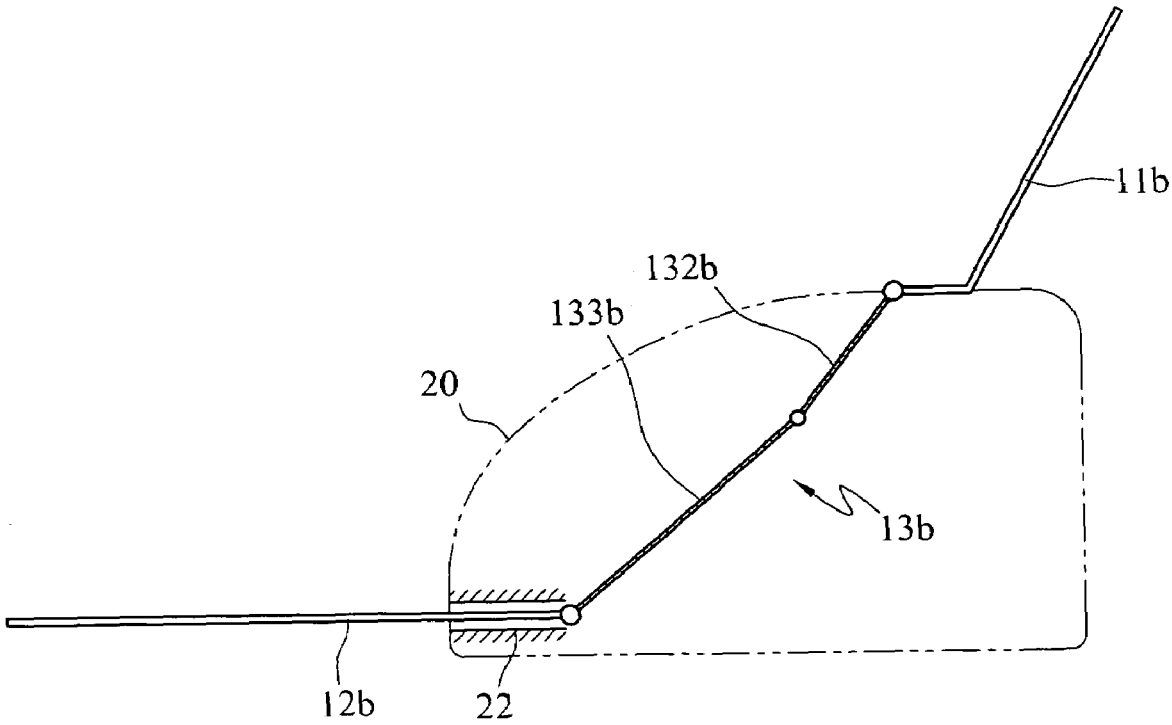

As shown in FIGS. 2A and 2B, which shows the second embodiment of this invention, the input paper tray 11*b* is pivotally connected to the machine 20 at the rear end while the output paper tray 12*b* slides horizontally along the sliding track 22 inside the machine 20 (same as in the first embodiment). When both trays are not in use, input paper tray 11*b* is folded against the machine 20; when both trays are in use, input paper tray 11*b* is unfolded at an angle with respect to the machine 20 so that it can hold a plurality of papers.

Inside the machine 20, the input paper tray 11*b* and output paper tray 12*b* are linked by an interconnecting mechanism 13*b*. The interconnecting mechanism 13*b* consists of a first linkage 132*b* and a second linkage 133*b*. The first linkage 132*b* is fixed with the input paper tray 11*b* at one end while the other end is pivotally pinned to one end of the second linkage 133*b*; the other end of the second linkage 133*b* is pivotally pinned to the output paper tray 12*b*. Since both ends of the second linkage 133*b* are pivotally attached to the first linkage 132*b* and output paper tray 12*b* respectively, second linkage 133*b* is suspended inside the machine 20.

When both input and output paper trays (11*b* and 12*b*) are not in use, to set up both trays, the user has to rotate the input paper tray 11*b* clockwise to unfold the input paper tray 11*b*; at the same time, the input paper tray 11*b* drives the first linkage 132*b* and second linkage 133*b* to simultaneously rotate clockwise; the second linkage 133*b* then pushes the output paper tray 12*b* to slide leftward along the sliding track 22. To fold the input paper tray 11*b* against the machine 20 and stash the output paper tray 12*b* back into the machine 20, the user has to rotate the input paper tray 11*b* counterclockwise, which will automatically rotate both first linkage 132*b* and second linkage 133*b* counterclockwise to drag the output paper tray 12*b* rightward back into the machine 20. Nevertheless, instead of rotating the input paper tray 11*b*, the user can also pull/push the output paper tray 12*b* to unfold/fold and slide out/slide in both paper trays at the same time respectively.

Figure 3:
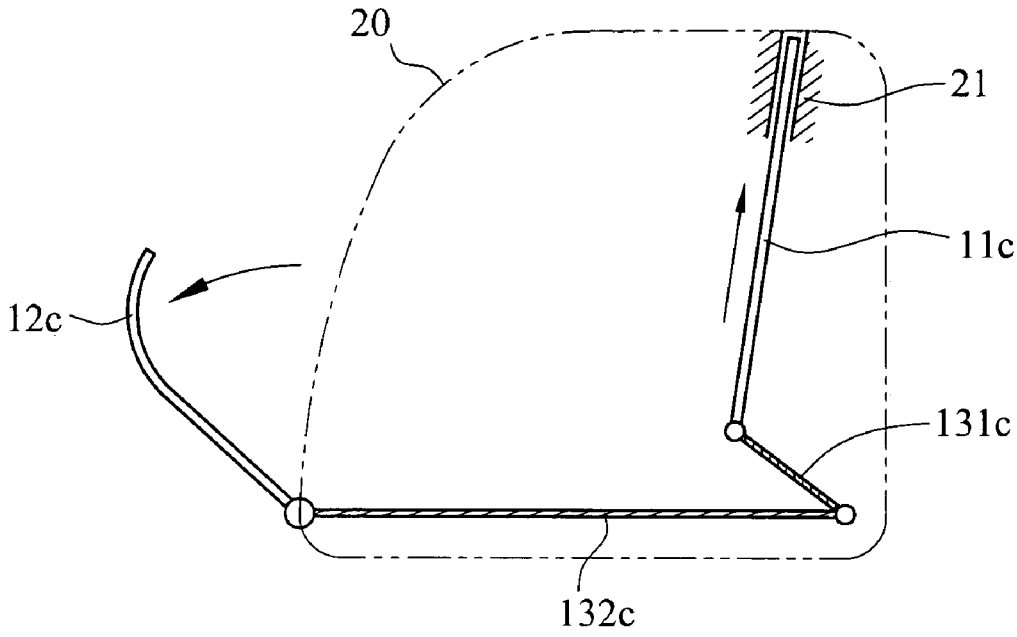
FIG. 3 is the side view of the third embodiment of this invention.

FIG. 3 shows the third embodiment of this invention. As shown in FIG. 3, the input paper tray 11*c* slides along the sliding track 21 inside machine 20, same as in the first embodiment of this invention. Yet, the output paper tray 12*c* is pivotally pinned to the machine 20 near the bottom. The output paper tray 12*c* is folded against the machine 20 when it is not in use; it is tilted at an angle with respect to the machine 20 when unfolded so that it can hold a plurality of papers.

The input paper tray 11*c* and output paper tray 12*c* are linked by an interconnecting mechanism 13*c* inside machine 20. The interconnecting mechanism 13*c* consists of a first linkage 132*c* and a second linkage 133*c*. The first linkage 132*c* is pivotally pinned with the input paper tray 11*c* at one end and to the second linkage 133*c* at the other end; the other end of the second linkage 133*c* is fixed with the output paper tray 12*c*. Since both ends of the first linkage 132*c* are pivotally pinned to the input paper tray 11*c* and second linkage 133*c*, the first linkage 132*c* is suspended inside the machine 20.

When both input and output paper trays (11*c* and 12*c*) are not in use, to set up both trays, the user has to pull the input paper tray 11*c* to slide it upward along the sliding track 21; at the same time, the input paper tray 11*c* drives the first linkage 132*c* to move upward and second linkage 133*c* to rotate counterclockwise respectively; the second linkage 133*c* then drives the output paper tray 12*b* to rotate counterclockwise. To stash the input paper tray 11*c* back into the machine 20 and fold the output paper tray 12*c* against the machine 20, the user has to push the input paper tray 11*b* to slide it back into the machine along the sliding track 21, which will automatically push the first linkage 132*c* and second linkage 133*b* to rotate the output paper tray 12*c* clockwise so that the output paper tray 12*c* is folded against the machine 20. Nevertheless, instead of pulling/pushing the input paper tray 11*c*, the user can also rotate the output paper tray 12*c* counterclockwise/clockwise to slide out/slide in and unfold/fold both paper trays at the same time respectively.

Figure 4:
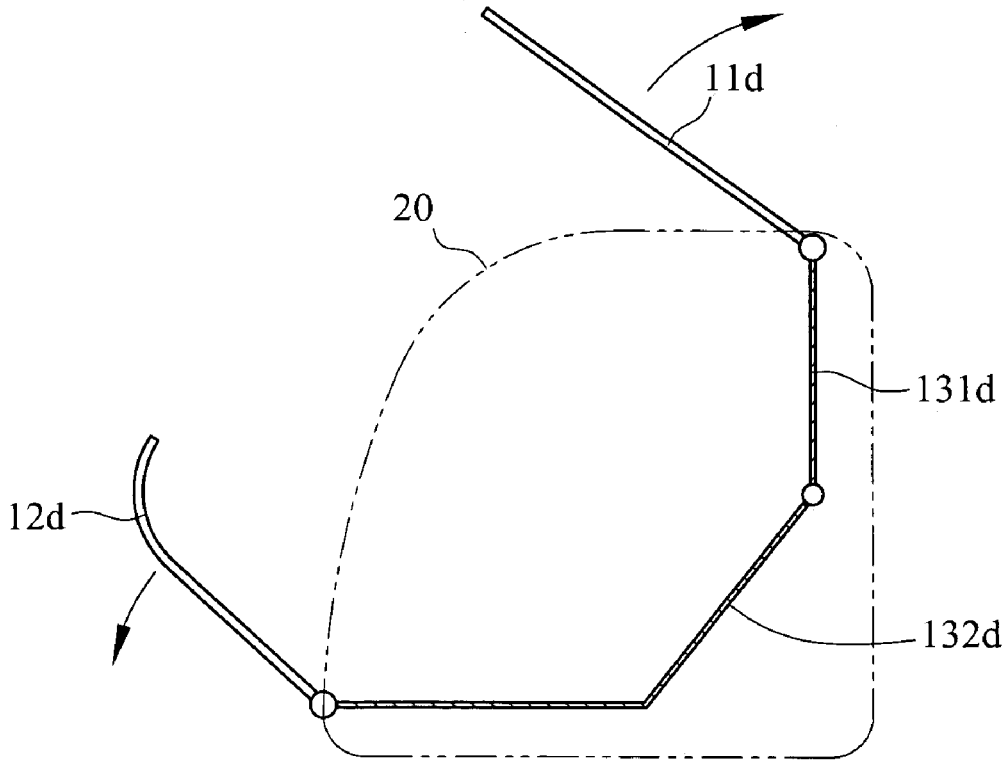
FIG. 4 is the side view of the fourth embodiment of this invention.

Referring to FIG. 4, in the fourth embodiment of this invention as shown, the input paper tray 11*d* is the same as in the second embodiment while the output paper tray 12*d* is the same as in the third embodiment. Both paper trays are pivotally attached to the machine 20 at the rear end and near the bottom respectively.

The input paper tray 11*d* and output paper tray 12*d* are linked by an interconnecting mechanism 13*d* inside the machine 20. The interconnecting mechanism 13*d* consists of a first linkage 132*d* and a second linkage 133*d*. The first linkage 132*d* is fixed with the input paper tray 11*d* at one end while the other end is pivotally pinned to one end of the second linkage 133*d*; the other end of the second linkage 133*b* is fixed with the output paper tray 12*d*. By rotating one of the paper trays, both paper trays are unfolded/folded simultaneously.

It should be understood that although four embodiments of this invention have been illustrated and some are explained in detail, various changes and modifications may be made therein by those skilled in the art without departing from the spirit of this invention or the scope of the appended claims.

What is claimed is:

1. A paper tray mechanism to be used inside a machine having paper trays, comprising:

an input paper tray, being movable and attaching inside said machine;

an output paper tray, being movable and attaching inside said machine relative to said input paper tray; and a linkage, being inside said machine between said output paper tray and input paper tray, and having one end attaching to said input paper tray and another end attaching to said output paper tray so that both the input and output paper trays move simultaneously.

2. The paper tray mechanism as claimed in claim 1, wherein said machine has a sliding track inside along which said input paper tray can slide.

3. The paper tray mechanism as claimed in claim 1, wherein said machine has a sliding track inside along which said output paper tray can slide.

4. The paper tray mechanism as claimed in claim 1, wherein said linkage is suspended inside said machine.

5. A paper tray mechanism to be used inside a machine having paper trays, comprising:

an input paper tray, being movable and pivotally attaching inside said machine;

an output paper tray, being linearly movable inside said machine relative to said input paper tray; and an interconnecting mechanism, being inside said machine between said output paper tray and input paper tray, including a first linkage and a second linkage pivotally pinned to each other, one end of said first linkage being fixed with said input paper tray and one end of said second linkage being pivotally pinned to said output paper tray, so that both the input and output paper trays move simultaneously.

6. The paper tray mechanism as claimed in claim 5, wherein said machine has a sliding track inside along which said output paper tray can slide.

7. The paper tray mechanism as claimed in claim 5, wherein said second linkage is suspended inside said machine.

8. A paper tray mechanism to be used inside a machine having paper trays, comprising:

an input paper tray, being linearly movable inside said machine;

an output paper tray, being movable and pivotally attaching inside said machine relative to said input paper tray; and an interconnecting mechanism, being inside said machine between said output paper tray and input paper tray, including a first linkage and a second linkage pivotally pinned to each other, one end of said first linkage being pivotally pinned to said input paper tray and one end of said second linkage being fixed with said output paper tray, so that both the input and output paper trays move simultaneously.

9. The paper tray mechanism as claimed in claim 8, wherein said machine has a sliding track inside along which said input paper tray can slide.

10. The paper tray mechanism as claimed in claim 8, wherein said first linkage is suspended inside said machine.

11. A paper tray mechanism to be used inside a machine having paper trays, comprising:

an input paper tray, being movable and pivotally attaching inside said machine;

an output paper tray, being movable and pivotally attaching inside said machine relative to said input paper tray; and an interconnecting mechanism, being inside said machine between said output paper tray and input paper tray, including a first linkage and a second linkage pivotally pinned to each other, one end of said first linkage being fixed with said input paper tray and one end of said second linkage being fixed with said output paper tray, so that both the input and output paper trays move simultaneously.

* * * * *